US005541479A

United States Patent [19]

Nagakubo

[11] Patent Number: 5,541,479

[45] Date of Patent: Jul. 30, 1996

[54] PLASMA DISPLAY DEVICE

[75] Inventor: Tetsurou Nagakubo, Koufu, Japan

[73] Assignee: Pioneer Electronic Corporation, Tokyo, Japan

[21] Appl. No.: 304,149

[22] Filed: Sep. 12, 1994

[30] Foreign Application Priority Data

Sep. 13, 1993 [JP] Japan ..... 5-226888

[51] Int. Cl.[6] ..... H01J 17/49

[52] U.S. Cl. ..... 313/586; 313/584; 313/587; 313/610; 313/612; 313/634; 313/113

[58] Field of Search ..... 313/113, 582, 313/584, 586, 587, 609, 610, 611, 612, 634; 220/2.1 R; 345/72

[56] References Cited

U.S. PATENT DOCUMENTS 4,803,402 2/1989 Raber et al. ..... 313/587
4,996,460 2/1991 Kim et al. ..... 313/587
5,150,965 9/1992 Fox ..... 313/610

FOREIGN PATENT DOCUMENTS 60-214868 9/1987 Japan .

*Primary Examiner*—Nimeshkumar D. Patel
*Attorney, Agent, or Firm*—Sughrue, Mion, Zinn, Macpeak & Seas

[57] ABSTRACT

A plasma display device having a face plate and a rear plate spaced apart from each other. Parallel sustaining electrodes are arranged preferably on the face plate, while parallel address electrodes are arranged preferably on the rear plate, so that they are spaced apart from and extend perpendicularly to the sustaining electrodes. Barrier ribs are disposed to define discharge gas spaces adjacent to crossovers of the electrodes. At least some of the barrier ribs are transparent barrier ribs made of a light-permeable material, so that, particularly when the rear plate is covered with a reflective layering, light which might otherwise leak from the rear plate is usefully saved and caused to radiate through the face plate, whereby the use ratio of the emitted light increases.

4 Claims, 7 Drawing Sheets

PLASMA DISPLAY DEVICE

BACKGROUND OF THE INVENTION

1. Field of the Invention

The present invention relates to a plasma display panel (hereinafter "PDP") used in a plasma display apparatus, and particularly to a structure of a barrier rib for partitioning adjacent unit cells.

2. Description of the Invention

The PDP utilizes an emission caused by an electric discharge between the crossovers of matrix electrodes in a rare gas mixture. A basic structure of the PDP is constructed by a plurality of line electrodes and row electrodes spaced therefrom which are formed on two glass plates respectively, and a discharge space (about 0.1 mm spaced) which is filled with a rare gas mixture containing Neon (Ne) mainly at hundreds Torr. The PDP is generally classified into the DC type (or direct discharge type) in which the electrodes are exposed in the discharge space and the AC type (or direct discharge type) in which the electrodes are covered with a dielectric layer. The AC type PDP is driven by a voltage application method such as a refresh method, a matrix address method, self-shift method and so on.

FIG. 1, for example, shows an AC type PDP with a matrix address method which comprises a face plate 1 and a rear plate 2 facing and parallel to each other, and a discharge gas space 4 defined by these plates and insulating barrier ribs 3. The barrier rib partitions pixel cells to prevent the adjacent cells from leaking ultraviolet rays produced by the electrical discharge. In addition, the barrier rib is generally formed of a light-absorbing material to prevent the reflection of incident lights entering from the outside and improve the contrast of an image displayed on the PDP.

A plurality of address electrodes W are formed parallel to each other on the rear plate 2. A dielectric layer 23 is formed on and over the address electrodes W. A plurality of pairs of sustaining electrodes S are formed parallel to each other on the dielectric layer 23 so as to cross the address electrodes W. Another dielectric layer 23 is formed on and over the sustaining electrodes S. A MgO layer 24 is formed on this dielectric layer 23. Barrier ribs 3 are formed on the MgO layer 24 by means of a printing method so as to rise above the surface of layer 24.

A face plate 1 is put on and over the tops of the barrier ribs. Fluorescent layers 11 are formed on the internal surface of the face plate so as to correspond to unit cells respectively. The face plate 1 and the rear plate 2 are aligned with each other and then assembled, after which a discharge gas space 4 is defined into which a rare gas mixture is injected. In this way, a transparent type PDP is manufactured.

This PDP is operated as follows: When a predetermined voltage is applied across each pair of the address electrodes W and the sustaining electrodes S embedded in the dielectric layer, a discharging region appears above the rear plate 2 at the crossover point of each pair of electrodes. Ultraviolet rays emitted from the discharging region stimulate the fluorescent layer 11 to emit light, and an emission region is produced in the discharge gas space 4. This discharged emission is maintained by a sustaining voltage applied between the sustaining electrodes, but canceled by an erase pulse applied between the address electrodes W.

In addition, a reflecting type PDP has been proposed in which a fluorescent layer is additionally formed in the internal surface of the barrier rib or the rear plate, so that the area of emission is expanded, to thereby provide an improvement of emission efficiency in comparison with forming the fluorescent layer in only the inner surface of the face plate, as in the above transparent type PDP. Even with such an arrangement, all light emitted from the discharging region or the fluorescent layer does not radiate through the display surface. A part of the light is absorbed by the barrier rib and another part is leaked from the rear plate. Accordingly, there is a strong demand in the art for improving the emission efficiency of PDPS.

SUMMARY OF THE INVENTION

It is considered that, for reducing the emission loss caused by the barrier rib or the rear plate, the barrier rib should be made of a white material, or a white layer should be formed on the surface of the rear plate to reflect light incident on the barrier rib or the rear plate. However, the emission efficiency of the PDP is insufficient even though such a reflecting structure is employed.

It is, therefore, an object of the present invention to provide a high emission efficient PDP.

The object of the present invention is achieved in accordance with the invention, which in one aspect is a plasma display device and in another aspect to is a method of manufacturing a glass plate having transparent barrier ribs for use in a plasma display device.

In its device aspect, the invention comprises:

- a pair of a face plate and a rear plate spaced apart from each other;
- a plurality of first parallel electrodes arranged on said face plate between said face plate and said rear plate;
- a plurality of second parallel electrodes arranged on said rear plate and spaced apart from and perpendicular to said first electrodes between said face plate and said rear plate; and
- a plurality of barrier ribs each disposed between a pair of the adjacent first or second electrodes for defining a discharge gas space adjacent to crossovers of said electrodes, wherein said barrier rib is a transparent barrier rib made of a light-permeable material.

In the present invention, the barrier ribs define and construct a plurality of pixel cells arranged in a matrix or line. Each barrier rib may comprise a light-permeable layer and a light-reflecting layer layered in sequence from a view in side of the PDP, as a two layer structure.

In comparison with a conventional barrier rib in a monochrome PDP absorbing light emitted from Neon (Ne) gas, and in a color PDP absorbing light emitted from the fluorescent layer, the present invention has barrier ribs in which the light-reflecting layer adjacent to the rear plate reflects light emitted by the fluorescent layer and the emitted and reflected lights pass through the light-permeable layer. As a result, the light loss is very much less so that the emission efficiency is enhanced.

In the method aspect according to the present invention, there is provided a method for forming barrier ribs used in a plasma display device comprising the steps of:

- coating a surface of a glass plate with a glass paste as a glass paste layer;
- drying the glass paste layer to be hardened;
- forming a sandblasting-proof mask having a predetermined rib pattern on the dried glass paste layer; and
- performing a sandblasting on the masked glass paste layer so that barrier ribs are provided after removing said mask.

DESCRIPTION OF THE PREFERRED EMBODIMENT

An embodiment of a PDP according to the invention will be described hereinbelow with reference to the accompanying drawings.

Figure 1:
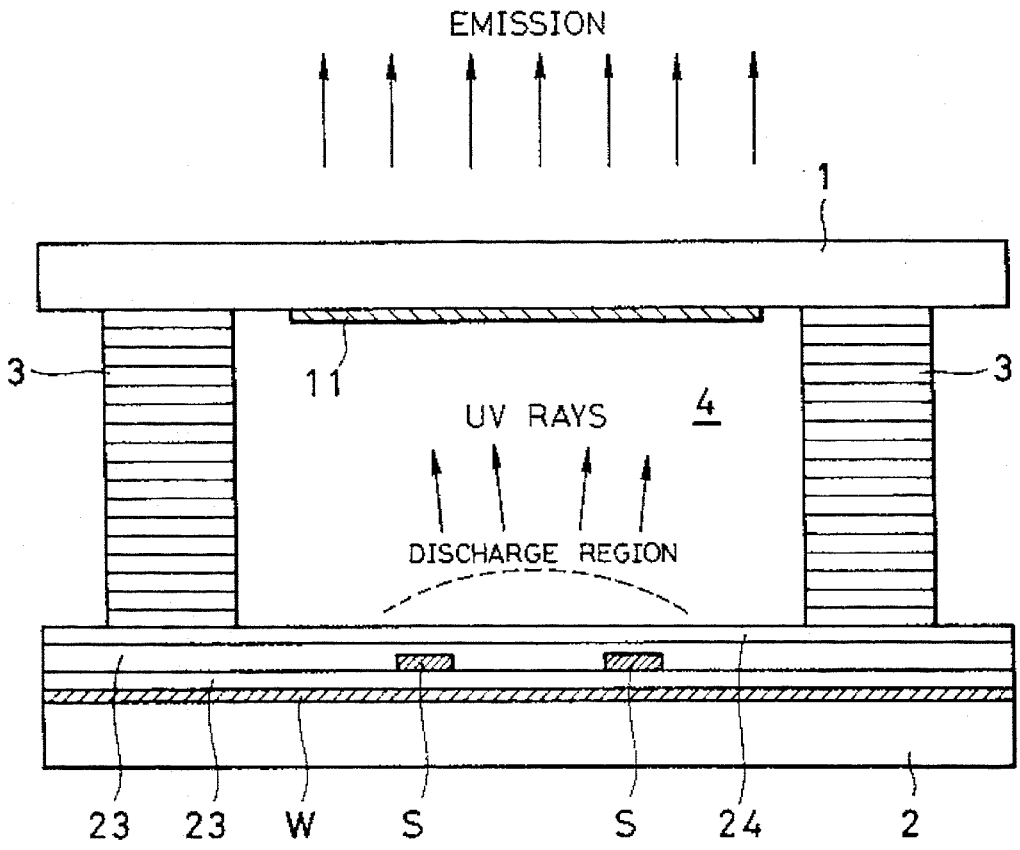
FIG. 1 PRIOR ART
FIG. 1 is a schematic sectional view partially broken showing a conventional PDP.
Figure 2:
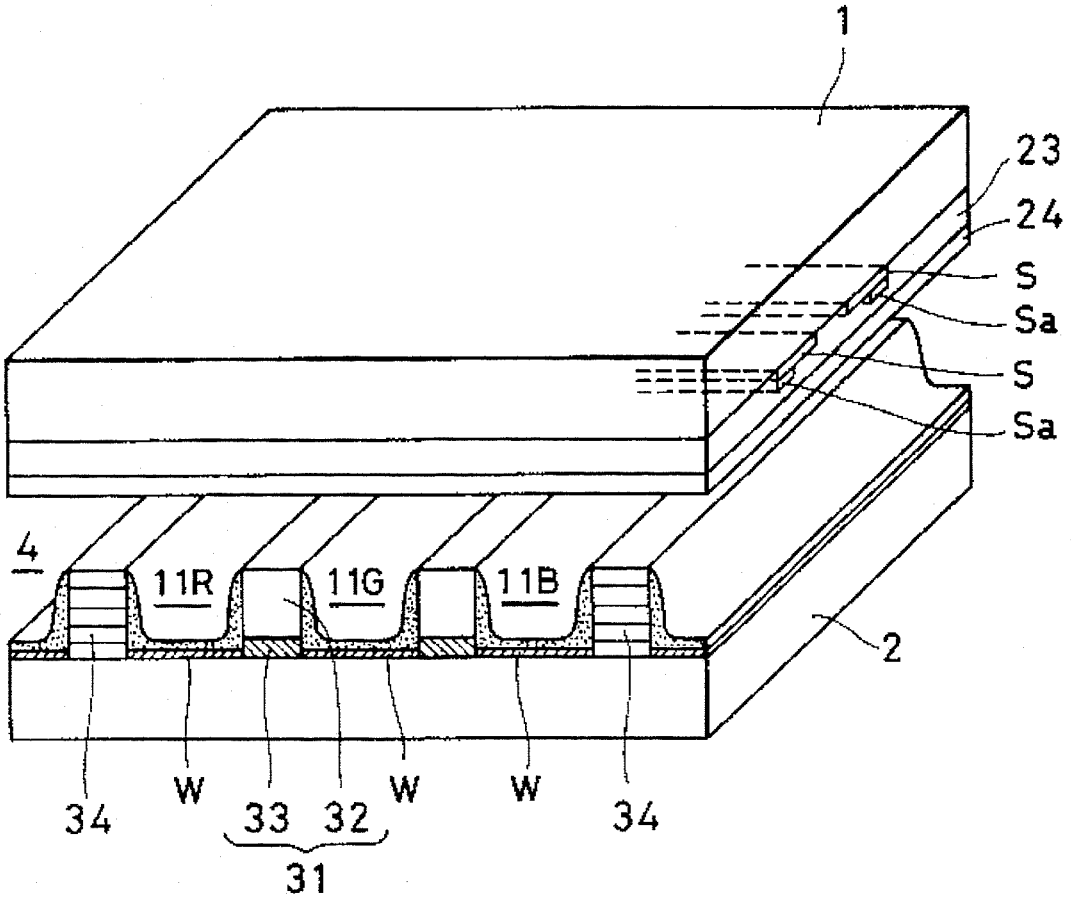
FIG. 2 is a schematic perspective view partially broken showing a PDP of one preferred embodiment according to the present invention.

FIG. 2 is a schematic perspective view partially broken showing the construction of a PDP according to a preferred embodiment.

In FIG. 2, sustaining electrodes S are arranged parallel to each other on the internal surface of a face plate 1 of the display surface (which faces to a rear plate 2) and each being made of a transparent conductive material, for example, Indium Tin oxide (so called ITO) or Tin oxide (SnO).

Auxiliary sustaining electrodes Sa made of a conductive material such as a metal are formed and contacted onto and along the sustaining electrodes S to reduce line-resistance of the sustaining electrodes. Each auxiliary sustaining electrode Sa has a narrower width than that of the sustaining electrode S. The auxiliary sustaining electrode Sa extends in the longitudinal direction of the sustaining electrode S and is disposed at the edge thereof in such a manner that the auxiliary sustaining electrode disturb the emitted light as little as possible. A dielectric layer 23 is formed on over these electrodes S, Sa. A MgO layer 24 made of Magnesium oxide is formed on the dielectric layer 23.

Moreover, transparent barrier ribs 31 are formed on the internal surface of a rear plate 2 facing the face plate 1 in such a manner that they are disposed parallel to each other and perpendicular to the sustaining electrodes S. Each transparent barrier rib 31 comprises a light-permeable layer 32 and a light-reflecting layer 33, providing a two layer structure. The light-permeable layer 32 is made of a hardened light-permeable glass paste in the main portion of the transparent barrier rib 31 adjacent to the face plate 1 of the display surface. The light-reflecting layer 33 is made of a hardened white glass paste and layered on the rear plate 2 as a thin film.

Furthermore, when a color PDP is manufactured, opaque barrier ribs 34 are provided between the transparent barrier ribs 31 in order to define a pixel cell comprising three unit cells irradiating red, green and blue lights respectively for the color PDP. The pair of the opaque barrier ribs 34 are arranged on both sides of a set of red, green and blue unit cells to partition the adjacent sets. The opaque barrier rib 34 may be formed of a color material, for example, a white glass paste for reflecting light strongly, or a black glass paste for improving the contrast in the display surface.

Address electrodes W made of Aluminum (Al) or Aluminum alloy are formed between the adjacent transparent barrier ribs 31 on the rear plate 2 in such a manner that the address electrodes extend perpendicular to the sustaining electrodes. These address electrodes are classified so as to make a set of three electrodes corresponding to red, green and blue color signals for the color PDP. Fluorescent layers 11R, 11G and 11B made of red, green and blue emitting fluorescent materials are formed on these corresponding address electrodes W and covers the side surfaces of the transparent barrier rib 31. Alternatively, the address electrodes W may be made of a metal having a high reflectivity such as Cu, Au and the like in lieu of Al or Al alloy.

The address electrodes W and the light-reflecting layer 33 are disposed close to or connecting to each other so that emitted light does not leak to the rear plate 2. The address electrodes W are contacted to the light-reflecting layer 33 at the extending edge thereof. In other words, the address electrodes W are positioned between the adjacent transparent barrier ribs 31 so that the address electrodes W and the light-reflecting layer 33 cover the internal surface of the rear plate, to become an internal reflecting layer, preferably.

A discharge gas space 4 is defined by the MgO layer 24 on the face plate 1 and the fluorescent layers 11R, 11G and 11B on the rear plate 2 and between the transparent barrier ribs 31. Rare gas mixture such as Ne—Xe gas or He—Xe gas is enclosed in the discharge gas space 4.

In this way, the barrier ribs of the present embodiment have at least one transparent barrier rib portion made of a light-permeable material and defines the discharge gas space adjacent to the crossover point of the sustaining electrodes S and the address electrodes W.

In the above embodiment, the sustaining electrodes are placed on the face plate and the address electrodes are disposed on the rear plate. However, the present invention is not limited to such an electrode structure. In another embodiment, all of the sustaining electrodes and the address electrodes may be arranged on the rear plate. In addition, when a color PDP is manufactured, the fluorescent layers 11R, 11G and 11B can be coated on at least one of side wall of the barrier ribs 31 and the rear plate. The transparent barrier rib structure made of a light-permeable material may be applied to the above AC type PDP or the DC type PDP. This transparent barrier rib structure may be applied to a monochrome PDP without any fluorescent layer. In addition, the transparent barrier ribs 31 as shown in FIG. 2 may be formed on the face plate 1 instead of the rear plate 2 of the above embodiment. The transparent barrier ribs 31 as shown in FIG. 2 may be formed in a matrix-like (grid-like) formation shown instead of the line-like formation.

Next, the operation of the present embodiment will be described as follows:

Ultraviolet rays caused by the electric discharge stimulate the fluorescent layer 11 to emit light. Almost all of the emitted light directly enters the face plate 1 and radiates toward the outside through the display surface. The other emitted light, or light which does not directly enter the face plate 1, goes to the rear plate 2 or the transparent barrier rib 31. The light going to the rear plate 2 is reflected by the address electrodes W with a high reflectivity towards the transparent barrier ribs 31. The light going to the transparent barrier ribs 31 passes and radiates from the face plate 1. Even though the passing light partially reflects to the light-reflecting layer 33, it is reflected again by the layer 33 and radiates through the face plate 1. Accordingly, the light going toward the rear plate 2 and the side walls of the transparent barrier ribs 31 will indirectly enter the face plate 1 and radiate through the display surface.

In comparison with the conventional PDP, in which the light portion emitted from the fluorescent layer is absorbed by a barrier rib or leaked through the rear plate, the transparent barrier rib of the present embodiment will pass and reflect such otherwise wasted light to the face plate and radiate to the outside. Therefore, the present invention reduces the light loss of emitted light from the fluorescent layer and enhances the emission efficiency of the unit cell to increase the luminance of the display surface to be higher than that of the conventional PDP.

Next, an embodiment of a method for manufacturing a PDP will be described as follows:

(Preparation of face plate members)

First, a thin film of ITO at a thickness of hundreds nanometers is formed, by means of the vapor deposition, on the surface of a glass face plate provided with an injection hole which is well washed, and then, this thin film is processed by the photolithography method and the etching method so that a plurality of parallel sustaining electrodes are formed. Next, a thin film of a conductive metal such as Al is vapor-deposited to form the sustaining electrodes and then processed by the above photolithography and etching methods, so that a plurality of slender auxiliary sustaining electrodes sa are formed on the sustaining electrodes S at the edges respectively and extend in the longitudinal direction of the sustaining electrodes.

Next, The sustaining electrodes and the auxiliary sustaining electrodes on the glass plate are coated with a light-permeable glass paste at a thickness of approximately 10 micrometers by means of the printing method, so that the light-permeable glass paste layer covers these electrodes. This glass face plate is sintered at a temperature of approximately 400–600 centigrade so that a dielectric layer of the hardened glass paste is formed. Next, a MgO layer is formed on this dielectric layer, by means of electron beam vapor deposition, at a thickness of approximately hundreds of nanometers. In this way, the face plate member is prepared.

(Preparation of rear plate members)

A light-permeable glass paste is printed on the surface of a well washed rear plate of glass, by using a screen having a predetermined parallel pattern, through use of the screen thick film printing technique. This printing is repeated, with each printing producing a thickness of approximately 10 micrometers, so that parallel transparent barrier ribs are formed at a height of 100–200 micrometers and a width of 50 micrometers with a pith of 300 micrometers. In this case, since the thicker the thickness of the paste layer per printing the more deformation of the rib occurs due to the expansion of the paste, it is preferable to put paste layers one upon another at a thickness of 10–20 micrometers per individual printing. The multiple printing is performed by using a plurality of the same printing master screens for the multi-layer of paste, but the aligning of the masters onto the glass plate is complicated. Therefore, it is preferable that the printing master be repeatedly used as the same pattern printing master for the multiple printing for the light-reflecting layer, and after that, the light-permeable layer is printed thereon by the same manner, and vice versa.

In other words, when the transparent barrier ribs are formed on the face plate, the light-permeable layer may be formed on the face plate at a predetermined thickness and then the light-reflecting layer is formed on the light-permeable layer.

In this screen printing of the barrier rib, the mixture of a light-permeable glass paste and a white pigment or dye is coated as a light-reflecting layer on the rear plate and then the light-permeable glass paste is multiple-printed on the light-reflecting layer so that the transparent barrier rib comprising the light-permeable layer and the reflecting layer are formed.

Next, a plurality of address electrodes W of Al are formed between the adjacent transparent barrier ribs on the rear plate at a thickness of approximately 100 nanometers by using the above vapor deposition, photolithography and etching methods.

Figure 3A:
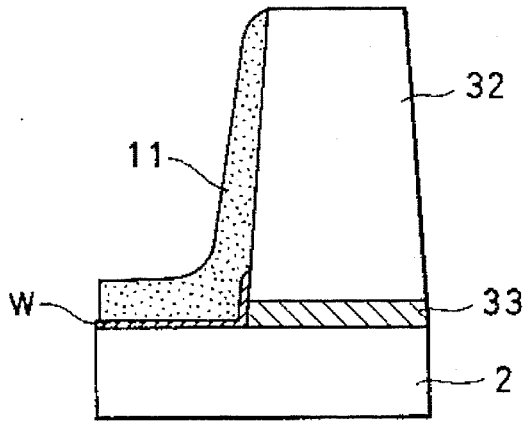
FIGS. 3A, 3B and 3C are enlarged sectional views showing transparent barrier ribs of preferred embodiments according to the present invention respectively.
Figure 3B:
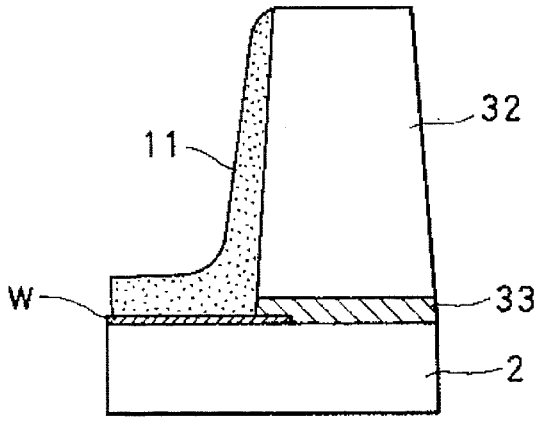

Next, the address electrodes are covered with the fluorescent materials corresponding to R, G and B respectively, each at a thickness of 10–30 micrometers, so as to be adjacent to the light-reflecting layer of the barrier rib by means of the printing method. This glass plate is sintered at a temperature of approximately 400–600 centigrade. In this way, the rear plate member is prepared. Since address electrodes are formed after forming the transparent barrier rib, the side wall of the transparent barrier rib 31 may be partially covered with a portion of the address electrode W as shown in FIG. 3A. If the transparent barrier ribs are formed; after forming the address electrodes, the lower edge of the transparent barrier rib 31 may cover the edge of the address electrode W as shown in FIG. 3B.

Figure 3C:
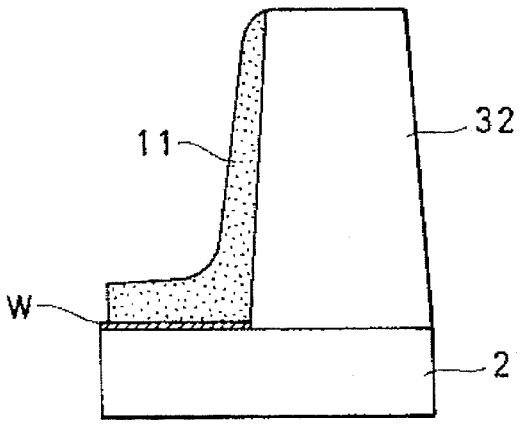

In addition to the above transparent barrier rib, formed as a two layer structure of the light-reflecting layer 33 and the light-permeable layer 32 as shown in FIG. 2, a whole transparent barrier rib may be formed of only the light-permeable layer 32 as shown in FIG. 3C.

Figure 4A:
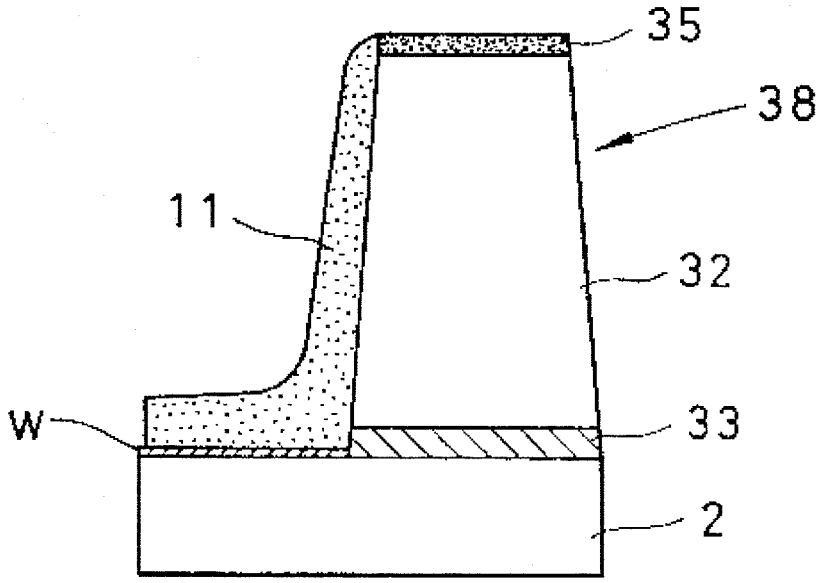
FIGS. 4A and 4B are enlarged sectional views showing transparent barrier ribs of other preferred embodiments according to the present invention respectively.
Figure 4B:
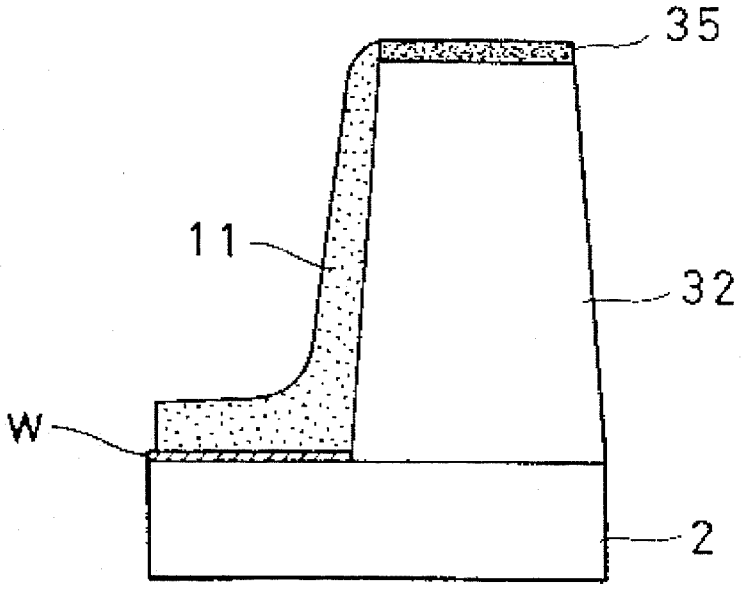

Furthermore, a colored layer 35 may be formed on the free top end of the light-permeable layer 32 of the transparent barrier rib 31 as shown in FIG. 4A. This may be done by means of the printing method to and produces a partially transparent barrier rib 38 for improving the contrast of the display. Similarly, the colored layer 35 may be formed on the free top ends of ribs 32 formed entirely of light-permeable material as shown in FIG. 4B.

Figure 5:
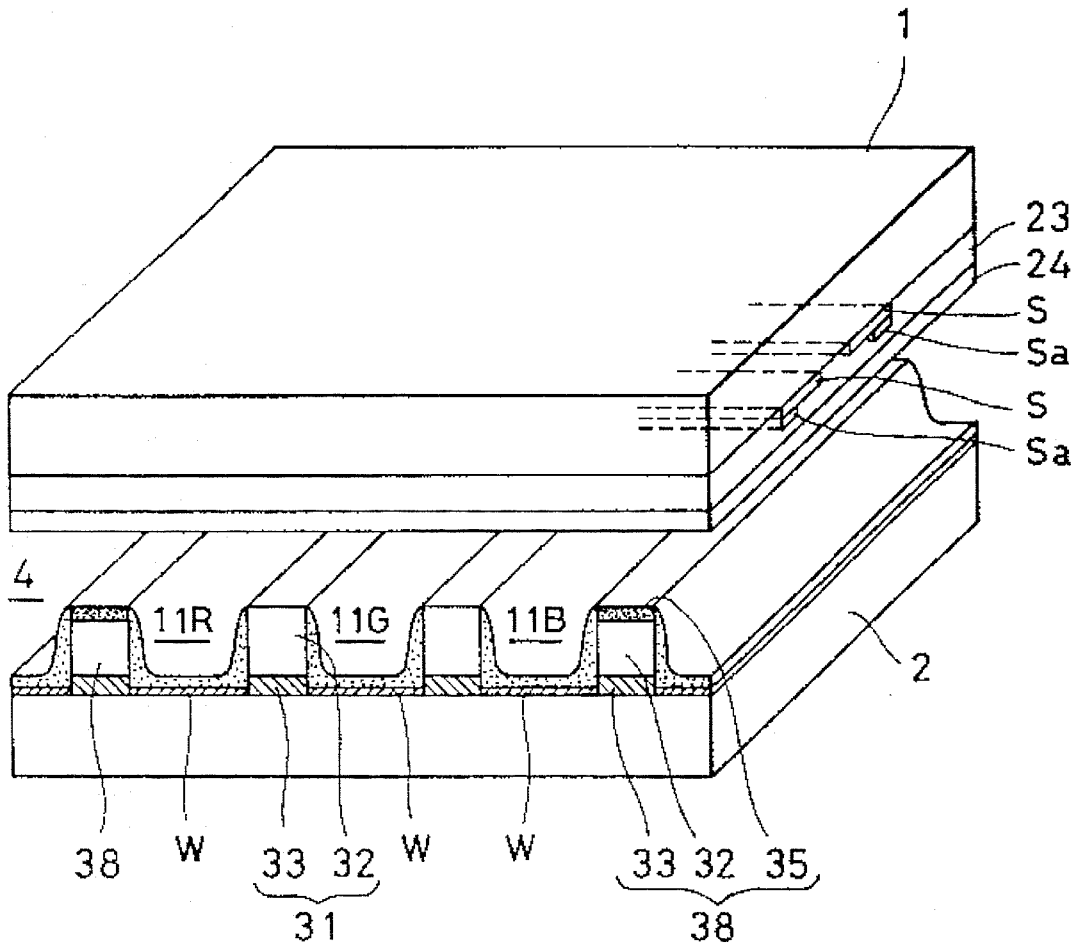
FIG. 5 is a schematic perspective view partially broken showing a PDP of another preferred embodiment according to the present invention.

In addition, the opaque barrier rib 34 as shown in FIG. 2 may be replaced by this transparent barrier rib 38 having a colored layer 35, in order to define the pixel cell as shown in FIG. 5.

The glass paste for the light-permeable layer 32 of the rib 31 is a mixture of a glass frit, a binder resin, a solvent and $Pb_2O_3$ powder and so on. When the white light-reflecting layer is formed, a white pigment such as Titanium oxide, Magnesium oxide or the like is added to the glass paste. When the opaque barrier rib 34 is formed, the binder in the rib is removed by baking the glass plate from the barrier rib to be black or other colored and then, the black or other color pigment or its solution is included.

(Assembling of PDP)

The face plate and the rear plate on which the given electrodes are prepared respectively are aligned in such a manner that the transparent barrier rib and address electrodes are perpendicular to the sustaining electrodes, and then predetermined spacers are disposed therebetween. The pair of plates is the sealed and integrated to maintain a discharge space. The discharge gas space is exhausted, and furthermore baked to remove the moisture on the surface of the MgO layer. Next, the discharge gas space is filled with Ne—Xe gas through the injection hole. After injecting the gas, the injection hole is sealed. As a result, a PDP is manufactured.

(Another preparation of the transparent barrier rib)

In addition to the above embodiment whereby the transparent barrier rib is formed by the multiple printing, there is another method for forming the ribs, as shown in FIG. 6, which illustrates a so called sandblasting method capable of producing a transparent barrier rib with one layer or two layer structure.

Figure 6A:
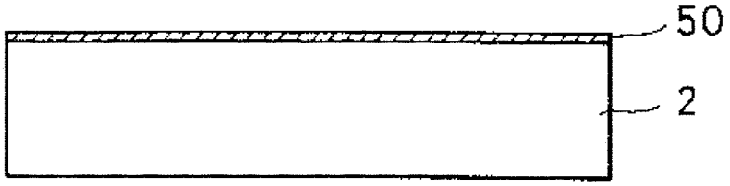
FIGS. 6A, 6B, 6C, 6D and 6E are sectional views showing basic members for forming transparent barrier ribs of one preferred embodiment according to the present invention respectively.
Figure 6B:
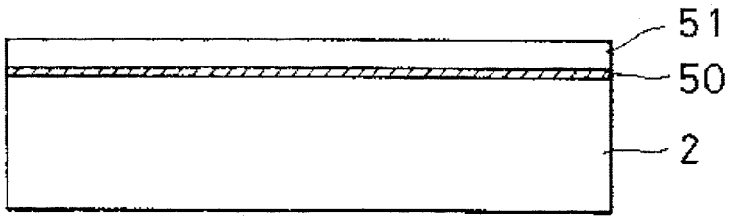
Figure 6C:
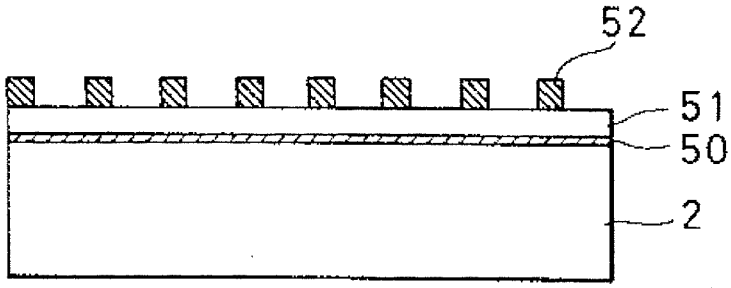
Figure 6D:
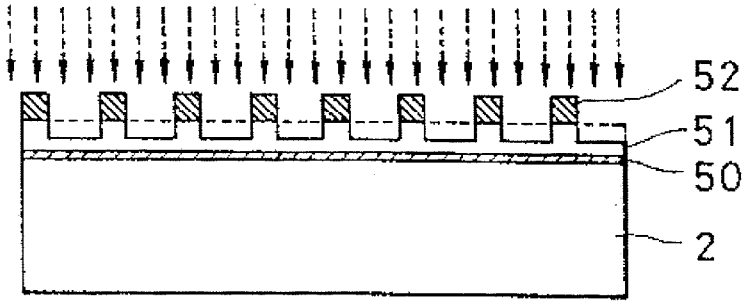
Figure 6E:
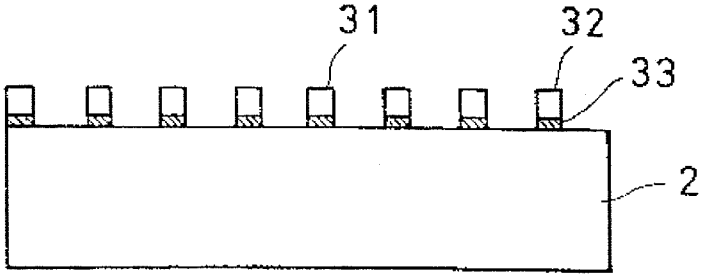

The two layer structure transparent barrier rib is constructed as follows: As shown in FIG. 6A, the surface of a rear plate 2 is uniformly coated with a white glass paste 50 to provide the thin light-reflecting layers. After drying the white paste layer, a light-permeable glass paste 51 is printed on the white paste layer at a predetermined thickness, as shown in FIG. 6B, and then dried. After that, a sandblasting-proof mask 52 having a predetermined rib pattern is formed on the light-permeable glass paste 51, as shown in FIG. 6C, by means of the photolithography method or printing method. Next, the sandblasting is performed from one side of the mask 52 as shown in FIG. 6D to form grooves of a predetermined depth for electrodes. After that, the mask 52 is removed as shown in FIG. 6E. In this way, transparent barrier ribs 31 of the two layer structure are shaped.

Furthermore, another method for forming barrier ribs is shown in FIG. 7, in which the transparent barrier ribs 31 of two layer structure and colored opaque barrier ribs 34 for defining RGB pixel cells are formed at the same time.

Figure 7A:
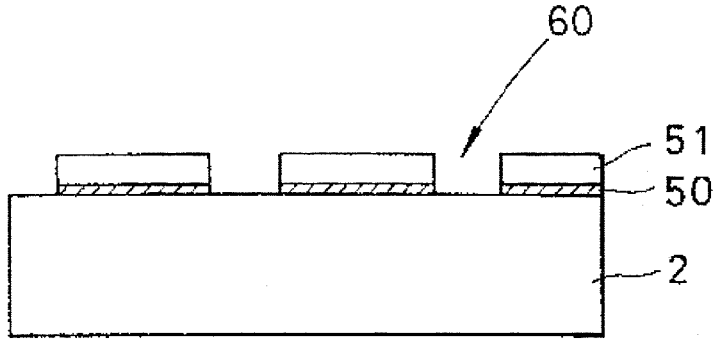
FIGS. 7A, 7B, 7C, 7D and 7E are sectional views showing basic members for forming transparent barrier ribs and opaque barrier ribs of another preferred embodiment according to the present invention respectively.
Figure 7B:
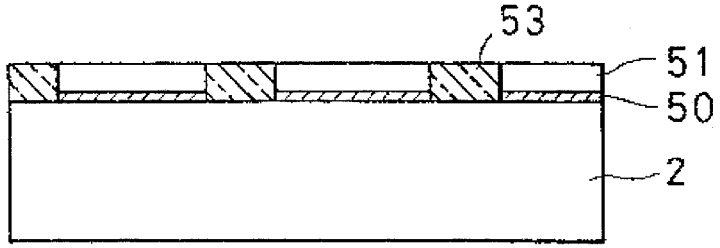
Figure 7C:
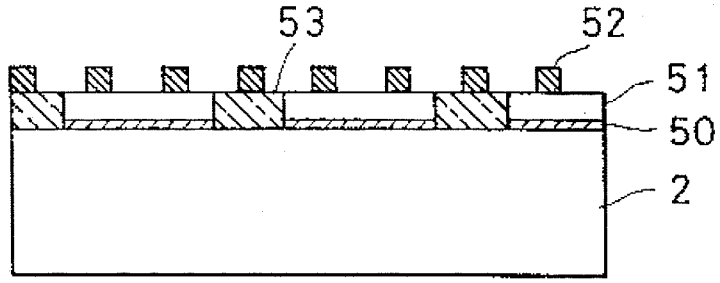
Figure 7D:
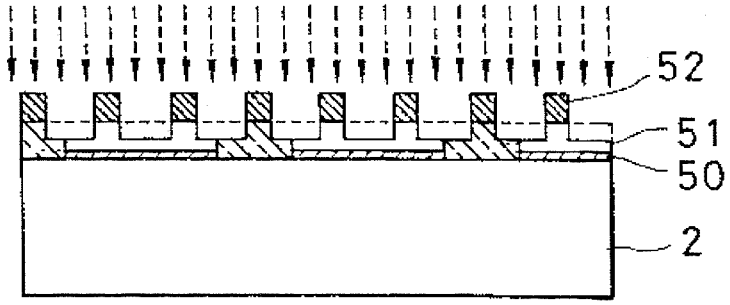
Figure 7E:
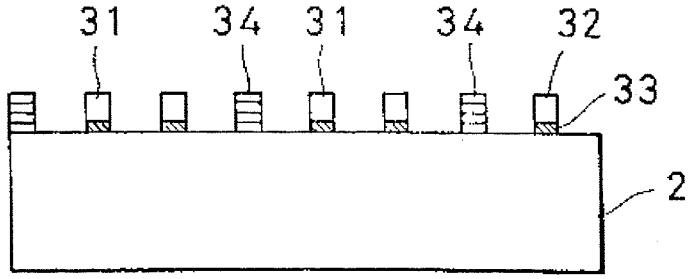

FIG. 7A shows that grooves 60 for forming colored opaque barrier ribs are formed into two layer substrate formed of a white glass paste 50 and light-permeable glass paste 51. The two layers 50 and 51 become the transparent barrier ribs on a rear plate 2 by using the above printing method and sandblasting method. The grooves 60 are filled with a colored glass paste 53 to provide opaque barrier ribs as shown in FIG. 7B. In other words, the necessary material layers for various barrier ribs are arranged in a mosaic, for example a stripe. After drying the plate, as shown in FIG. 7C, a sandblasting-proof mask 52 is formed on the light-permeable glass paste 51 and the colored glass paste 53 by means of the photolithography method or printing method. Next, the sandblasting is performed from the far side of the mask 52 to form grooves at a predetermined depth for the electrodes as shown in FIG. 7D. After that, the mask 52 is removed as shown in FIG. 7E, so that transparent barrier ribs 31 of two layer structure and opaque barrier ribs 34 are fashioned at the same time.

In this way, barrier ribs partitioning RGB unit cells existing in the range of the same pixel information to be displayed, are formed of a high permeable material. Furthermore, the other barrier ribs forming a boundary for an adjacent set of RGB unit cells, are formed of a non-permeable material in the present invention. Therefore, RGB lights passing through the transparent barrier ribs are mixed in the same pixel, but the RGB lights are prevented from entering adjacent pixels so that the resolution of the display is maintained and the quality is advanced.

According to the present invention, the barrier ribs of the PDP are made of a high permeable material. The light emitted in the unit cell is passed, reflecting or dispersed in the barrier and is directed through the face plate, so that the PDP pixel brightens per se. As a result, the appearing numerical number is therefore increased. Furthermore, it is preferable that RGB lights emitted from adjacent RGB unit cells in one pixel of the color PDP are mixed.

In addition, since the light-permeable barrier rib is provided with a high reflective material layer, for example a white layer, on the side of the rear plate, this reflecting layer presents light from leaking from the rear plate. Instead, this reflecting layer causes this light to pass through the front face of the display surface as reflected light. In this way, the use ratio of the emitted light increases.

What is claimed is:

1. A plasma display device comprising:

a face plate and a rear plate spaced apart from each other;

a plurality of first parallel electrodes arranged on said face plate between said face plate and said rear plate;

a plurality of second parallel electrodes arranged on said rear plate and spaced apart from and perpendicular to said first electrodes between said face plate and said rear plate;

a plurality of barrier ribs each disposed between adjacent ones of said first or said second electrodes and parallel to said adjacent electrodes, adjacent ones of said barrier ribs defining respective discharge gas spaces adjacent to crossovers of said first and second electrodes; and fluorescent layers made of fluorescent materials for emitting red, green or blue light, each said layer formed over at least one of a side-wall of one of said barrier ribs and a surface of said rear plate between adjacent ones of said barrier ribs, so as to form information emitting pixels corresponding to red, green and blue color signals supplied to said electrodes;

wherein said barrier ribs are formed at least partly of a light-permeable material and partition red, green and blue unit cells, which cells together form a single one of said information emitting pixels.

2. A plasma display device according to claim 1, wherein said second electrodes are disposed between adjacent ones of said barrier ribs so that the second electrodes extend across internal surfaces of said rear plate other than surfaces over which said transparent barrier ribs are disposed.

3. A plasma display device according to claim 1, wherein at least some of said barrier ribs comprise a light-reflecting layer formed on said rear plate and a light-permeable layer made of a light-permeable material formed on said light-reflecting layer.

4. A plasma display device according to claim 3, wherein said second electrodes are disposed and extend between adjacent one of said light-reflecting layers of said barrier ribs so that the second electrodes and said light-reflecting layers fully extend across an internal surface of said rear plate, to provide an internal reflecting layer.

* * * * *